US010565937B2

(12) United States Patent
Hwang et al.

(10) Patent No.: US 10,565,937 B2
(45) Date of Patent: Feb. 18, 2020

(54) PIXEL SENSING APPARATUS AND PANEL DRIVING APPARATUS

(71) Applicant: SILICON WORKS CO., LTD., Daejeon (KR)

(72) Inventors: Dong Hyun Hwang, Seoul (KR); Hyun Ho Kim, Suwon-si (KR); Se Won Lee, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 15/829,659

(22) Filed: Dec. 1, 2017

(65) Prior Publication Data

US 2018/0166020 A1 Jun. 14, 2018

(30) Foreign Application Priority Data

Dec. 13, 2016 (KR) ..... 10-2016-0169324

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2320/0233* (2013.01); *G09G 2320/0626* (2013.01)

(58) Field of Classification Search
CPC ..... G09G 3/3233; G09G 3/3291; G09G 2320/045; G09G 2320/0233; G09G 2320/029; G09G 2320/0626; G09G 3/3258; G09G 2320/0295
See application file for complete search history.

(56) References Cited

U.S. PATENT DOCUMENTS

| | | | | |
|---|---|---|---|---|
| 6,586,888 | B2 | 7/2003 | Kitahara et al. | |
| 9,685,119 | B2 | 6/2017 | Kim et al. | |
| 2008/0252570 | A1* | 10/2008 | Kwon | G09G 3/3233 345/76 |
| 2010/0013811 | A1* | 1/2010 | Ahn | G09G 3/2003 345/207 |
| 2014/0240282 | A1* | 8/2014 | Hwang | F21V 15/01 345/174 |
| 2015/0154913 | A1* | 6/2015 | Kim | G09G 3/3233 345/691 |
| 2016/0063925 | A1* | 3/2016 | Bae | G01R 19/25 345/691 |
| 2017/0263173 | A1* | 9/2017 | Lin | G09G 3/2003 |

* cited by examiner

*Primary Examiner* — Gerald Johnson
(74) *Attorney, Agent, or Firm* — Fenwick & West LLP

(57) ABSTRACT

The present invention relates to technology for driving a display device, and provides technology which, in sensing pixels arranged in a panel, processes a signal having a wide range by using a low-voltage element.

14 Claims, 8 Drawing Sheets

PIXEL SENSING APPARATUS AND PANEL DRIVING APPARATUS

CROSS-REFERENCE TO RELATED APPLICATION

This application claims priority from Republic of Korea Patent Application No. 10-2016-0169324, filed on Dec. 13, 2016, which is hereby incorporated by reference for all purposes as if fully set forth herein.

BACKGROUND OF THE INVENTION

1. Field of the Invention

The present invention relates to technology for driving a display device.

2. Description of the Prior Art

A display device includes a source driver for driving pixels arranged in a panel.

A source driver determines a data voltage according to image data and supplies the data voltage to pixels, so as to control the brightness of each pixel.

Meanwhile, although an identical data voltage is supplied to pixels, brightnesses of the pixels may be different according to characteristics thereof. For example, each pixel includes a driving transistor, and when the threshold voltage of the driving transistor is changed, although an identical data voltage is supplied to the pixels, the brightness of each pixel is changed. When a source driver does not consider such a change in characteristics of pixels, the pixels may be driven such that the pixels have undesired brightnesses, and thus, the problem of degradation of image quality may occur.

Specifically, pixels have characteristics changed according to the elapse of time or a surrounding environment. At this time, when a source driver supplies a data voltage to the pixels without considering the changed characteristics of the pixels, problems of degradation of image quality (e.g., a screen spot, etc.) arise.

In order to alleviate the problems of degradation of image quality, a display device may include a pixel sensing apparatus that senses characteristics of pixels.

The pixel sensing apparatus may receive a sensing signal of each pixel through a sensing line connected to each pixel. Then, the pixel sensing apparatus converts the sensing signal into pixel sensing data and transmits the pixel sensing data to a timing controller, and the timing controller detects the characteristics of each pixel by using the pixel sensing data. Then, the timing controller may reflect the characteristics of each pixel in compensating image data, thereby alleviating the problems of degradation of image quality according to the difference between pixels.

Meanwhile, in order to accurately sense the characteristics of a pixel, the pixel sensing apparatus may sense a pixel under multiple conditions. Here, magnitudes of sensing signals received from the pixel under the respective conditions may be different. For example, a sensing signal may have a voltage level ranging from −6 to 0 volts under a first condition, and may have a voltage level ranging from 0 to 6 volts under a second condition.

To process all of the sensing signals having such various magnitudes, the conventional pixel sensing apparatus uses a high-voltage element. However, the high-voltage element has poorer element characteristics than those of a low-voltage element, and thus degrades the sensing accuracy. Also, the high-voltage element has a larger area than that of the low-voltage element, and thus increases the manufacturing costs.

SUMMARY OF THE INVENTION

Therefore, the objective of embodiments of the present invention is to provide technology which, in pixel sensing, processes a signal having a wide range by using a low-voltage element.

In order to achieve the above-described objective, in accordance with an aspect of the present invention, there is provided a pixel sensing apparatus for sensing a characteristic of a pixel disposed in a display panel. The pixel sensing apparatus may include driving voltage reception terminals that are supplied with a low driving voltage (VSS) and a high driving voltage (VDD) each having a voltage level changed according to a mode. The pixel sensing apparatus may further include a sensing unit that is driven while being supplied with the low driving voltage (VSS) and the high driving voltage (VDD), and receives, from the pixel, a sensing signal having a voltage level between the low driving voltage (VSS) and the high driving voltage (VDD). Also, the pixel sensing apparatus may further include an output unit that outputs pixel sensing data corresponding to the sensing signal.

In accordance with another aspect of the present invention, there is provided a pixel sensing apparatus for sensing a characteristic of a pixel disposed in a display panel. The pixel sensing apparatus may include a sensing unit that is driven while being supplied with a low driving voltage (VSS) and a high driving voltage (VDD) each having a voltage level changed according to a mode, and receives, from the pixel, a sensing signal having a voltage level between the low driving voltage (VSS) and the high driving voltage (VDD). Also, the pixel sensing apparatus may further include an analog-to-digital conversion unit that converts an analog signal into digital data. Also, the pixel sensing apparatus may further include a voltage level conversion unit that receives an output signal of the sensing unit, and converts a voltage level of the output signal to output the analog signal having a voltage level in an input voltage range of the analog-to-digital conversion unit. Further, the pixel sensing apparatus may further include an output unit that outputs pixel sensing data generated according to the digital data.

In accordance with still another aspect of the present invention, there is provided a panel driving apparatus for driving a panel having multiple pixels arranged therein and having multiple data lines and multiple sensing lines, which are connected to the pixels, arranged therein. The panel driving apparatus may include a data driving circuit that converts image data into a data voltage and supplies the data voltage to the data lines. Also, the panel driving apparatus may further include a sensing circuit that is driven while being supplied with a low driving voltage (VSS) and a high driving voltage (VDD) each having a voltage level changed according to a mode, receives, through the sensing lines, sensing signals each having a voltage level between the low driving voltage (VSS) and the high driving voltage (VDD), and generates pixel sensing data respectively corresponding to sensing signals. Further, the panel driving apparatus may further include a data processing circuit that performs processing for compensating the image data by using the pixel sensing data.

As described above, in pixel sensing, the embodiments of the present invention allow processing of a signal having a wide range by using a low-voltage element. Also, the present invention allows the use of a low-voltage element, and thus can increase the accuracy of pixel sensing and reduce the area of an element, thereby reducing the manufacturing costs.

BRIEF DESCRIPTION OF THE DRAWINGS

The above and other objects, features, and advantages of the present invention will be more apparent from the following detailed description taken in conjunction with the accompanying drawings, in which.

DETAILED DESCRIPTION OF THE EXEMPLARY EMBODIMENTS

Figure 1:
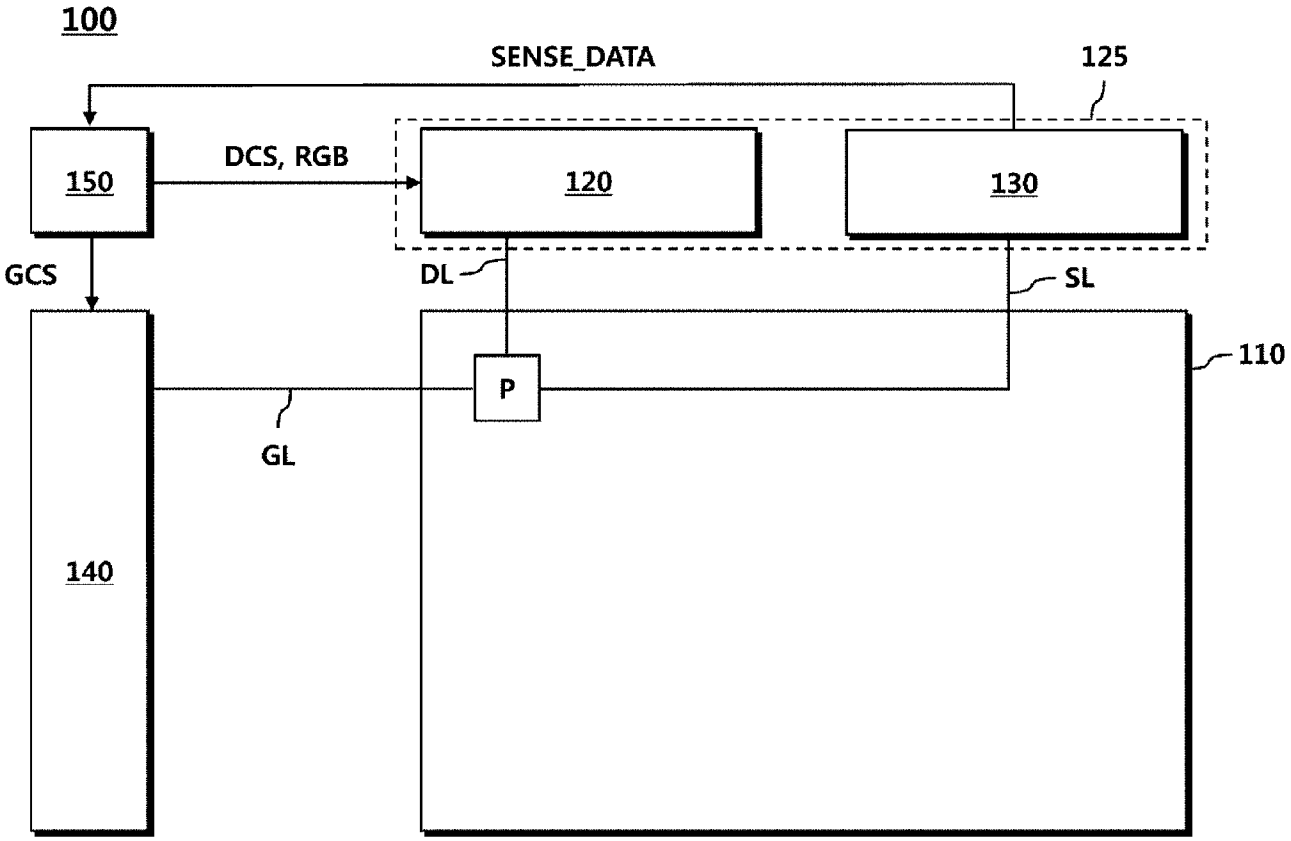
FIG. 1 is a block diagram illustrating a configuration of a display device according to an embodiment of the present invention.

Hereinafter, exemplary embodiments of the present invention will be described in detail with reference to the accompanying drawings. It should be noted that in assigning reference numerals to elements in the drawings, the same reference numerals will designate the same elements where possible although they are shown in different drawings. Also, in the following description of embodiments of the present invention, a detailed description of known functions and configurations incorporated herein will be omitted when it may make the subject matter of embodiments of the present invention rather unclear.

In addition, such terms as first, second, A, B, (a), (b), and the like, may be used herein when describing elements of embodiments of the present invention. These terms are merely used to distinguish one element from other elements, and a property, an order, a sequence, and the like of a corresponding element are not limited by the term. It will be understood that when an element is described as being "connected", "linked", or "coupled" to another element, the element may be directly connected or coupled to the another element but may be indirectly "connected", "coupled", or "linked" to the another element through a third element.

FIG. 1 is a block diagram illustrating a configuration of a display device according to an embodiment of the present invention.

Referring to FIG. 1, the display device 100 may include a panel 110, and a panel driving apparatus 120, 130, 140, and 150 that drives the panel 110.

The panel 110 may have multiple data lines DL, multiple gate lines GL, and multiple sensing lines SL arranged therein, and may have multiple pixels P arranged therein.

The panel driving apparatus may include a data driving circuit 120, a sensing circuit 130, a gate driving circuit 140, a data processing circuit 150, and the like.

In the panel driving apparatus, the gate driving circuit 140 may supply the gate lines GL with a scan signal having a turn-on or turn-off voltage. When a scan signal having a turn-on voltage is supplied to a pixel P, the relevant pixel P is connected to a data line DL. When a scan signal having a turn-off voltage is supplied to the pixel P, the connection between the relevant pixel P and the data line DL is disconnected.

In the panel driving apparatus, the data driving circuit 120 supplies a data voltage to the data lines DL. A data voltage supplied to a data line DL is delivered to a pixel P connected to the data line DL according to a scan signal.

In the panel driving apparatus, the sensing circuit 130 receives a sensing signal (e.g., a voltage, a current, etc.) formed at each pixel P. The sensing circuit 130 may be connected to each pixel P according to a scan signal or a separate sensing signal. Here, a sensing signal may be generated by the gate driving circuit 140.

In the panel driving apparatus, the data processing circuit 150 may supply various control signals to the gate driving circuit 140 and the data driving circuit 120. The data processing circuit 150 may generate a gate control signal GCS for starting a scan according to a timing implemented in each frame and may transmit the generated gate control signal GCS to the gate driving circuit 140. Also, the data processing circuit 150 may output, to the data driving circuit 120, image data RGB into which image data input from the outside is converted to meet the format of a data signal used in the data driving circuit 120. Further, the data processing circuit 150 may transmit a data control signal DCS which controls the data driving circuit 120 to supply a data voltage to each pixel P so as to match each timing.

The data processing circuit 150 may compensate image data RGB according to the characteristics of a pixel P and transmit the compensated image data. At this time, the data processing circuit 150 may receive pixel sensing data (SENSE_DATA) from the sensing circuit 130. The pixel sensing data (SENSE_DATA) may include a measurement value of the characteristics of the pixel P. The data processing circuit 150 may perform processing for compensating image data RGB according to the pixel sensing data (SENSE_DATA), and then may transmit the compensated image data to the data driving circuit 120.

Meanwhile, the data driving circuit 120 may be referred to as "source driver". Also, the gate driving circuit 140 may be referred to as "gate driver". Also, the data processing circuit 150 may be referred to as "timing controller". The data driving circuit 120 and the sensing circuit 130 may be included in one Integrated Circuit (IC) 125 and may be referred to as "source driver IC". Further, the data driving circuit 120, the sensing circuit 130, and the data processing circuit 150 may be included in one IC and may be referred to as "combined IC". Embodiments of the present invention are not limited to the names, but in the following description of embodiments thereof, a description of some generally-known elements of a source driver, a gate driver, a timing controller, and the like will be omitted. Therefore, the omission of some elements should be considered in understanding of embodiments of the present invention.

Meanwhile, the panel 110 may be an organic light-emitting display panel. Here, pixels P arranged in the panel 110 may include Organic Light-Emitting Diodes (OLEDs) and one or more transistors. Characteristics of an OLED and a transistor included in each pixel P may be changed according to the elapse of time or a surrounding environment. The sensing circuit 130 according to an embodiment of the present invention may sense characteristics of the elements included in each pixel P and may transmit the sensed characteristics to the data processing circuit 150.

Figure 2:
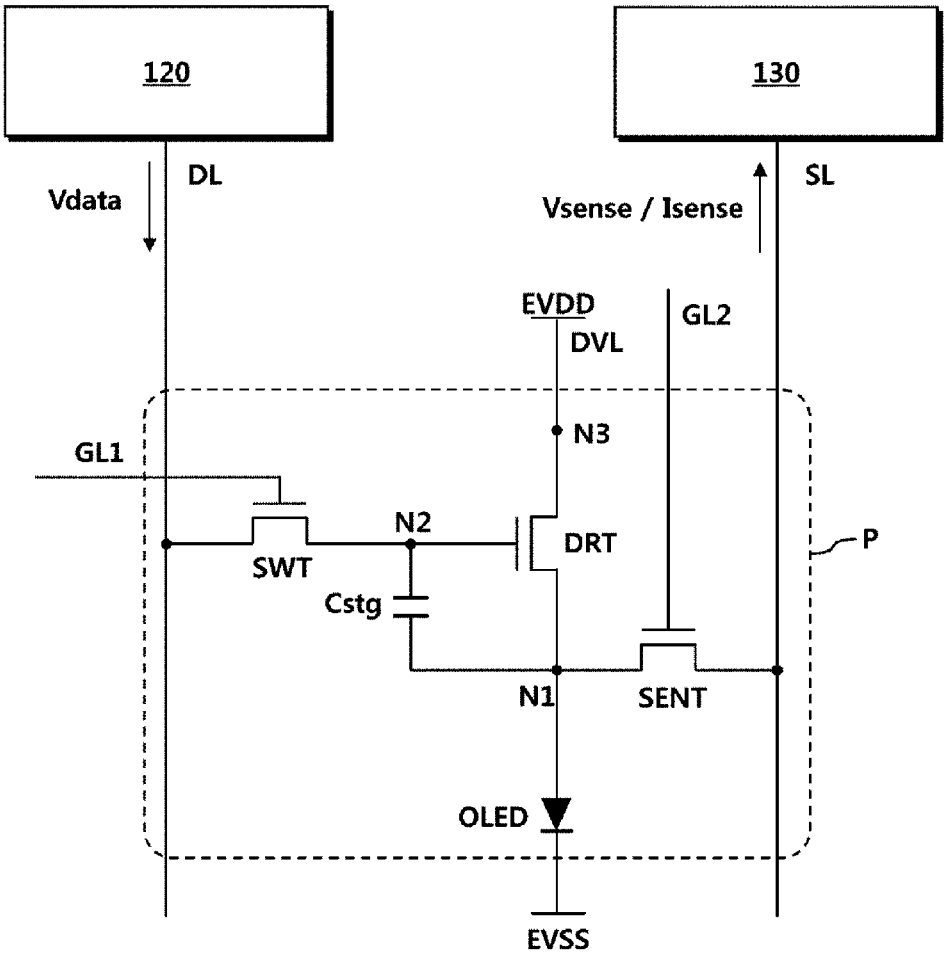
FIG. 2 is a circuit diagram illustrating a pixel configuration of each pixel of FIG. 1, and an input voltage from each of a data driving circuit and a sensing circuit to a pixel and an output voltage from the pixel to each of the data driving circuit and the sensing circuit.

FIG. 2 is a circuit diagram illustrating a pixel configuration of each pixel of FIG. 1, and an input voltage from each of a data driving circuit and a sensing circuit to a pixel and an output voltage from the pixel to each of the data driving circuit and the sensing circuit.

Referring to FIG. 2, a pixel P may include an OLED, a driving transistor DRT, a switching transistor SWT, a sensing transistor SENT, a storage capacitor Cstg, and the like.

The OLED may include an anode electrode, an organic layer, a cathode electrode, and the like. As according to the control of the driving transistor DRT, the anode electrode of the OLED is connected to a driving voltage EVDD and the cathode electrode thereof is connected to a base voltage EVSS, the OLED emits light.

The driving transistor DRT may control the brightness of the OLED by controlling a driving current supplied to the OLED.

A first node N1 of the driving transistor DRT may be electrically connected to the anode electrode of the OLED, and may be a source node or drain node. A second node N2 of the driving transistor DRT may be electrically connected to a source node or drain node of the switching transistor SWT, and may be a gate node. A third node N3 of the driving transistor DRT may be electrically connected to a driving voltage line DVL supplying the driving voltage EVDD, and may be a drain node or source node.

The switching transistor SWT may be electrically connected between a data line DL and the second node N2 of the driving transistor DRT, and may be turned on by being supplied with a scan signal through gate lines GL1 and GL2.

When the switching transistor SWT is turned on, a data voltage Vdata supplied from the data driving circuit 120 through the data line DL is delivered to the second node N2 of the driving transistor DRT.

The storage capacitor Cstg may be electrically connected between the first and second nodes N1 and N2 of the driving transistor DRT.

The storage capacitor Cstg may be a parasitic capacitor existing between the first and second nodes N1 and N2 of the driving transistor DRT, or may be an external capacitor intentionally designed outside the driving transistor DRT.

The sensing transistor SENT may connect the first node N1 of the driving transistor DRT to a sensing line SL, and the sensing line SL may deliver a reference voltage Vref to the first node N1 and may deliver the characteristic value (e.g., the voltage or current) of the first node N1 to the sensing circuit 130.

Then, the sensing circuit 130 may measure the characteristics of the pixel P by using a sensing signal Vsense or Isense delivered through the sensing line SL.

When the voltage of the first node N1 is measured, the threshold voltage, mobility, current characteristic, and the like of the driving transistor DRT may be detected. Also, when the voltage of the first node N1 is measured, the degradation degree of the OLED, including the parasitic capacitance, current characteristic, and the like thereof, may be detected.

The sensing circuit 130 may measure the voltage of the first node N1, and may transmit a measurement value to the data processing circuit (refer to reference numeral 150 in FIG. 1). Then, the data processing circuit (refer to reference numeral 150 in FIG. 1) may detect the characteristics of each pixel P by analyzing the measured voltage of the first node N1.

The data processing circuit (refer to reference numeral 150 in FIG. 1) may detect the characteristics of the pixel P by using multiple measurement values. For example, when detecting the mobility of the driving transistor DRT or the current characteristic of the OLED, the data processing circuit (refer to reference numeral 150 in FIG. 1) may use multiple measurement values.

Meanwhile, when the data processing circuit (refer to reference numeral 150 in FIG. 1) detects the characteristics of a pixel P by using multiple measurement values, a sensing signal Vsense or Isense delivered from the pixel P may have a wide signal range.

The characteristics of the pixel P (e.g., the mobility of the driving transistor DRT, the current characteristic of the OLED, etc.) may have nonlinear characteristics. Accordingly, in order to accurately detect the characteristics of the pixel P, a sensing signal may have multiple voltage levels, including a low voltage level, an intermediate voltage level, a high voltage level, and the like.

Figure 3:
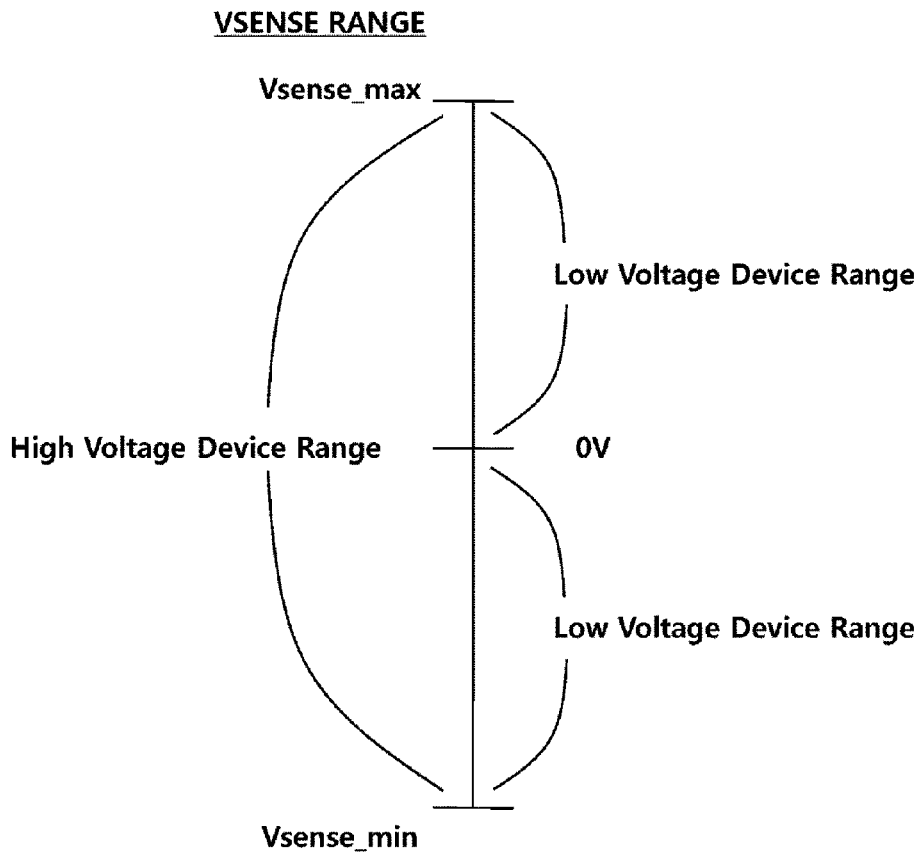
FIG. 3 is a view illustrating the voltage range of a sensing signal.

FIG. 3 is a view illustrating the voltage range of a sensing signal.

Referring to FIG. 3, a sensing signal may have a wide signal range (Vsense_min to Vsense_max). Also, the sensing signal may have not only a signal magnitude corresponding to a low-voltage element range, but also a signal magnitude corresponding to a high-voltage element range.

In order to process a sensing signal covering the high-voltage element range, a typical sensing circuit may be implemented by a high-voltage element.

Figure 4:
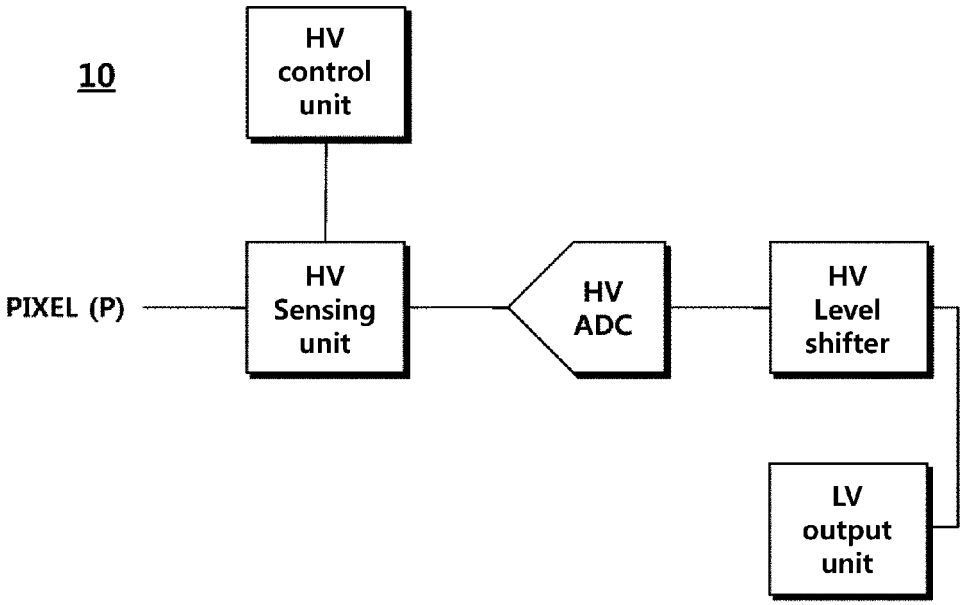
FIG. 4 is a block diagram illustrating a configuration of a typical sensing circuit.

FIG. 4 is a block diagram illustrating a configuration of a typical sensing circuit.

Referring to FIG. 4, the typical sensing circuit 10 includes a High-Voltage (HV) control unit, an HV sensing unit, an HV Analog-to-Digital Converter (HVADC), an HV level shifter, wherein they are implemented by HV elements, and a Low-Voltage (LV) output unit.

In order to process a sensing signal having a wide voltage range, the typical sensing circuit 10 includes an HV control unit, an HV sensing unit, an HVADC, and the like which are implemented by HV elements. Also, for an LV output unit implemented by an LV digital circuit, the typical sensing circuit 10 further includes an HV level shifter that converts an HV signal into an LV signal.

Since an HV element has low sensing accuracy and a large area, the typical sensing circuit 10 implemented by such HV elements has problems of low accuracy and high manufacturing costs.

In order to solve the problems of the typical sensing circuit, a sensing circuit according to an embodiment of the present invention processes a sensing signal by using a variable driving voltage.

Figure 5:
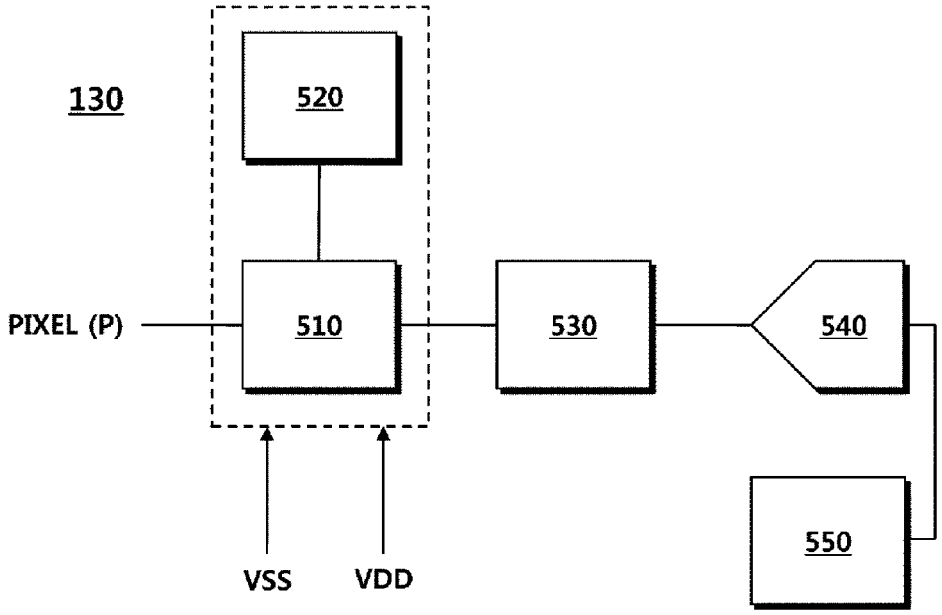
FIG. 5 is a block diagram illustrating a configuration of a sensing circuit according to an embodiment of the present invention.

FIG. 5 is a block diagram illustrating a configuration of a sensing circuit according to an embodiment of the present invention.

Referring to FIG. 5, the sensing circuit 130 may include a sensing unit 510, a control unit 520, a voltage level conversion unit 530, an analog-to-digital conversion unit 540, an output unit 550, and the like.

According to an embodiment of the present invention, the sensing unit 510, the control unit 520, the voltage level conversion unit 530, an analog-to-digital conversion unit 540, and the output unit 550 which are included in the sensing circuit 130 may be implemented by LV elements.

Here, an LV element may signify an element having a withstand voltage level lower than or equal to a predetermined level, and for example, an element, which has a withstand voltage level lower than or equal to a predetermined magnitude (e.g., 6 V), may be referred to as "LV element". Alternatively, an LV element may be relatively defined, and for example, among the elements used in the typical sensing circuit (refer to reference numeral 10 in FIG. 4) described with reference to FIG. 4, the elements each having a high withstand voltage level may be defined as HV elements. An element, which has a withstand voltage level lower than or equal to a predetermined level (e.g., 50% or less) as compared with such HV elements, may be defined as an LV element.

Meanwhile, a voltage level applied to an element is smaller than the withstand voltage level of the element, and each of the sensing unit 510 and the control unit 520, which controls the sensing unit 510, may distinguish between modes in order to cover a signal range of a sensing signal which is larger than the withstand voltage level thereof, and may be driven while being supplied with a low driving voltage VSS and a high driving voltage VDD which are changed at different voltage levels according to modes.

At this time, a mode may be controlled by the data processing circuit (refer to reference numeral 150 in FIG. 1). The data processing circuit (refer to reference numeral 150 in FIG. 1) may use multiple measurement values to detect the characteristics of a pixel. Then, the data processing circuit (refer to reference numeral 150 in FIG. 1) may transmit a mode control signal to the sensing circuit 130 and the like while pre-configuring a mode corresponding to each measurement value.

Figure 6:
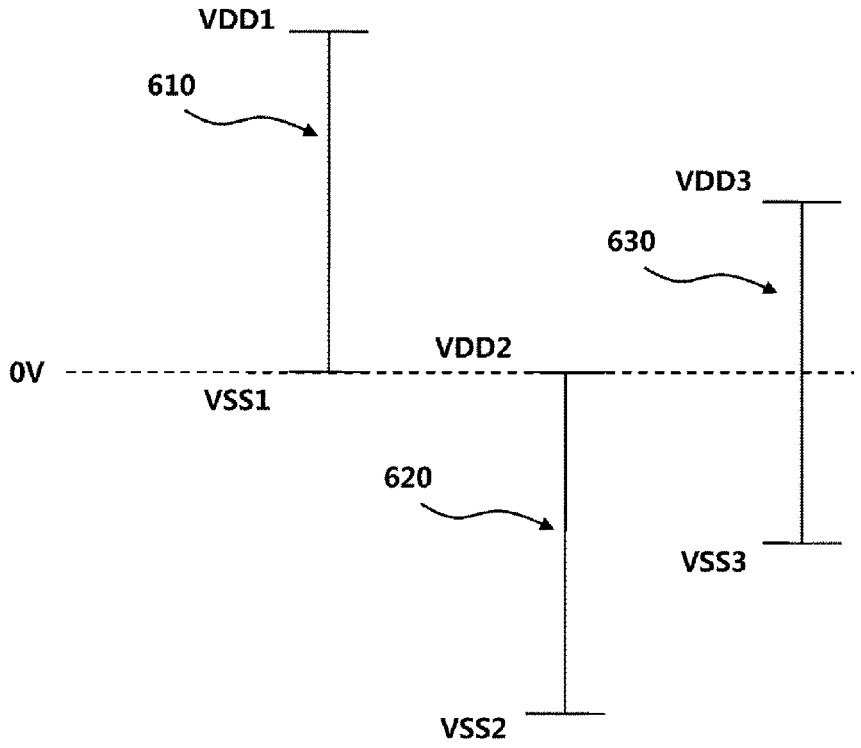
FIG. 6 is a view illustrating a low driving voltage and a high driving voltage according to a mode.

FIG. 6 is a view illustrating a low driving voltage and a high driving voltage according to a mode.

Referring to FIG. 6, in a first mode 610, a low driving voltage may be a first low driving voltage VSS1 and a high driving voltage may be a first high driving voltage VDD1. Here, the first low driving voltage VSS1 may be 0 V, and the first high driving voltage VDD1 may be a voltage higher than the maximum value of a sensing signal. The first mode 610 may be referred to as "positive voltage sensing mode".

In a second mode 620, a low driving voltage may be a second low driving voltage VSS2 and a high driving voltage may be a second high driving voltage VDD2. Here, the second low driving voltage VSS2 may be a voltage lower than the minimum value of a sensing signal, and the second high driving voltage VDD2 may be 0 V. The second mode 620 may be referred to as "negative voltage sensing mode".

In a third mode 630, a low driving voltage may be a third low driving voltage VSS3 and a high driving voltage may be a third high driving voltage VDD3. Here, a driving voltage range (VSS3 to VDD3), which is determined according to low and high driving voltages, may include 0 V.

Referring to FIG. 6, driving voltage ranges in at least two modes may partially overlap. For example, driving voltage ranges in the first and third modes 610 and 630 may partially overlap, and driving voltage ranges in the second and third modes 620 and 630 may partially overlap. A problem occurring at a boundary of the modes can be solved by a partial overlap between driving voltage ranges. Also, the driving voltage range in the third mode 630 includes 0 V, and thus, this configuration can solve a dead zone problem near a voltage of 0 occurring when a period is divided into two sub-periods and the two sub-periods are sensed in corresponding modes.

The driving voltage ranges in the respective modes may be identical, and from a different perspective, voltage differences between low and high driving voltages in the respective modes may be substantially identical to each other.

Referring to FIGS. 5 and 6 together, in the first mode 610, the sensing unit 510 may be supplied with the first low driving voltage VSS1 and the first high driving voltage VDD1 as driving voltages, and may receive, from a pixel P, a sensing signal having a voltage level between the first low driving voltage VSS1 and the first high driving voltage VDD1.

Then, in the second mode 620, the sensing unit 510 may be supplied with the second low driving voltage VSS2 and the second high driving voltage VDD2 as driving voltages, and may receive, from a pixel P, a sensing signal having a voltage level between the second low driving voltage VSS2 and the second high driving voltage VDD2.

Then, in the third mode 630, the sensing unit 510 may be supplied with the third low driving voltage VSS3 and the third high driving voltage VDD3 as driving voltages, and may receive, from a pixel P, a sensing signal having a voltage level between the third low driving voltage VSS3 and the third high driving voltage VDD3.

As described above, the sensing unit 510 may divide a period of a sensing signal having a wide signal range into sub-periods according to multiple modes, and may sense all the sub-periods in the corresponding modes.

The withstand voltage level of an element may be determined by the difference between a low driving voltage VSS and a high driving voltage VDD, and since the difference between the low driving voltage VSS and the high driving voltage VDD has a predetermined magnitude or smaller in each of the modes 610, 620, and 630, the sensing unit 510 may not only have a wide signal range but may also be implemented by LV elements.

Meanwhile, each of the sensing unit 510 and the control unit 520 may be implemented by multiple elements, and the difference between the low driving voltage VSS and the high driving voltage VDD may be designed to be smaller than the value of the withstand voltage level of each element and to fall within a predetermined range with reference to the value of the withstand voltage level of each element. For example, when each of the sensing unit 510 and the control unit 520 is implemented by elements each having 5 V as a withstand voltage level, in each mode, the difference between the low driving voltage VSS and the high driving voltage VDD may be designed to be smaller than 5 V. Although FIG. 6 illustrates three modes as an example, the number of modes may become larger as the difference between the low driving voltage VSS and the high driving voltage VDD becomes smaller.

Alternatively, withstand voltage levels of elements constituting the sensing unit 510 and the control unit 520 may be lower than or equal to a particular voltage. Here, the particular voltage may be a voltage (e.g., 6 V) typically indicating an LV element.

The sensing unit 510, the control unit 520, the voltage level conversion unit 530, the analog-to-digital conversion unit 540, and the output unit 550, which are included in the sensing circuit 130, may be implemented by LV elements. Accordingly, maximum withstand voltage levels of the elements, which constitute the sensing unit 510, the control unit 520, the voltage level conversion unit 530, the analog-to-digital conversion unit 540, and the output unit 550, may be substantially identical to each other. In order to simplify a design and a process, identical types of elements may be used in each unit, and each of the sensing unit 510, the control unit 520, the voltage level conversion unit 530, the analog-to-digital conversion unit 540, and the output unit 550 may use LV elements. Therefore, withstand voltage levels of the elements constituting the units may be substantially identical to each other.

As a specific example, withstand voltage levels of the multiple first elements constituting the sensing unit 510 may be substantially identical to those of the multiple second elements constituting the output unit 550. Also, the withstand voltage levels of the multiple first elements constituting the sensing unit 510 may be lower than or equal to a particular voltage (a typically-designed withstand voltage level of an LV element). Similarly, withstand voltage levels of the multiple second elements constituting the output unit 550 may be lower than or equal to a particular voltage (a typically-designed withstand voltage level of an LV element).

Meanwhile, a driving voltage range determined by the low driving voltage VSS and the high driving voltage VDD may be included within a withstand voltage level. Specifically, the difference value between the high driving voltage VDD and the low driving voltage VSS may fall within a predetermined range with reference to values of withstand voltage levels of the elements constituting the sensing unit 510 and the control unit 520. The value of the withstand voltage level of an element may be larger than a driving voltage range, but when the value of the withstand voltage level of the element is significantly larger than the driving voltage range, due to the problem of an increase in manufacturing costs caused by an over-specification, the driving voltage range may fall within a predetermined range with reference to the value of the withstand voltage level of the element.

The voltage level conversion unit 530 may receive an output signal having a variable voltage range from the sensing unit 510, may convert a voltage level of the received output signal into an analog signal having a voltage level within a predetermined range, and may output the converted analog signal. Since the analog-to-digital conversion unit 540 and the output unit 550 is supplied with a predetermined driving voltage, according to each of the modes 610, 620, and 630, the voltage level conversion unit 530 may convert an output signal having a variable voltage range from the sensing unit 510 into an analog signal having a predetermined voltage range, and may output the converted analog signal.

An analog signal output from the voltage level conversion unit 530 may have a voltage level within a predetermined range. Here, the voltage level within the predetermined range may be the magnitude of the input voltage range of the analog-to-digital conversion unit 540.

Then, the analog-to-digital conversion unit 540 may convert an analog signal into digital data, and the output unit 550 may output pixel sensing data, which is generated according to the converted digital data, to the data processing circuit (reference numeral 150 in FIG. 1).

Meanwhile, the sensing unit 510 may output a reference voltage together with an output signal to deliver mode information to another unit.

Figure 7:
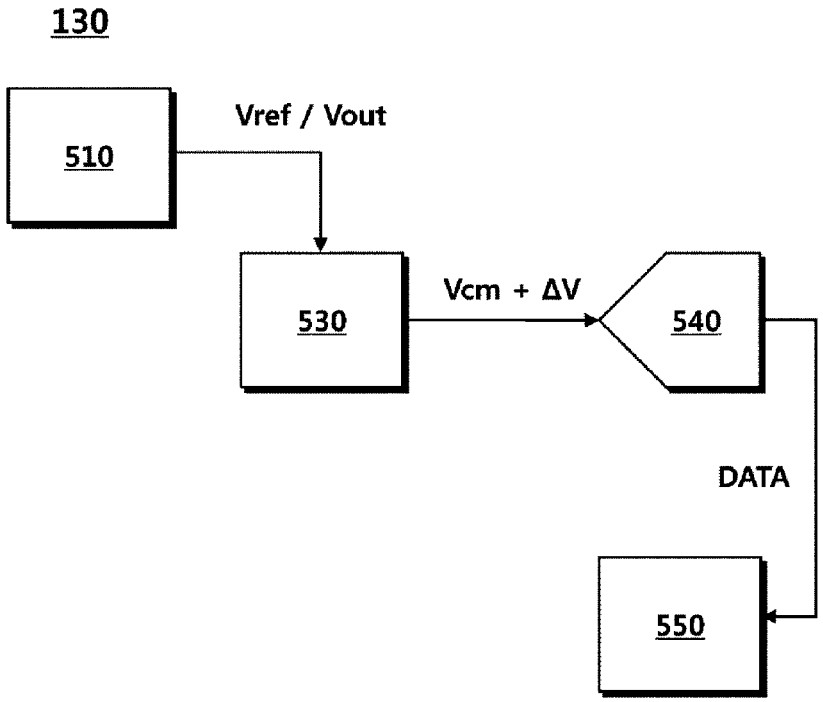
FIG. 7 is a view for explaining a process of delivering a reference voltage in a sensing circuit according to an embodiment of the present invention.

FIG. 7 is a view for explaining a process of delivering a reference voltage in a sensing circuit according to an embodiment of the present invention.

Referring to FIG. 7, the sensing unit 510 may output a reference voltage Vref together with an output signal Vout.

The reference voltage Vref may be determined according to voltage levels of the high driving voltage VDD and the low driving voltage VSS. For example, the reference voltage Vref may be an intermediate voltage between the high driving voltage VDD and the low driving voltage VSS. Alternatively, the reference voltage Vref may be the low driving voltage VSS or the high driving voltage VDD.

The voltage level conversion unit 530 may recognize a mode according to the reference voltage Vref. When the reference voltage Vref is an intermediate voltage between the high driving voltage VDD and the low driving voltage VSS, the voltage level conversion unit 530 may recognize the high driving voltage VDD and the low driving voltage VSS according to a voltage level of the reference voltage Vref, and accordingly, may also recognize a mode. As another example, the voltage level conversion unit 530 may predetermine a corresponding mode according to a voltage level of the reference voltage Vref, and when the reference voltage Vref is input, may recognize a mode corresponding to the input reference voltage Vref.

The voltage level conversion unit 530 may output, as an analog signal, a difference value ΔV between the reference voltage Vref and the output signal Vout. Alternatively, the voltage level conversion unit 530 may add the difference value ΔV and a predetermined voltage Vcm within the input voltage range of the analog-to-digital conversion unit 540, and may output the added difference value ΔV and predetermined voltage Vcm, as an analog signal.

The voltage level conversion unit 530 may output the reference voltage Vref or the predetermined voltage Vcm to the analog-to-digital conversion unit 540. The analog-to-digital conversion unit 540 may recognize a mode according to the reference voltage Vref, and when the analog-to-digital conversion unit 540 converts an input analog signal ΔV into digital data DATA, may reflect the recognized mode in the conversion. Alternatively, the analog-to-digital conversion unit 540 may convert an analog signal (Vcm+ΔV), which is input regardless of a sensing mode, into digital data DATA.

According to some embodiments of the present invention, the analog-to-digital conversion unit 540 may intactly convert an analog signal ΔV, which corresponds to a difference value, into digital data DATA regardless of a mode, and the data processing circuit (refer to reference numeral 150 in FIG. 1) may process pixel sensing data so as to reflect information on the mode.

Meanwhile, voltage levels of a low driving voltage and a high driving voltage may be changed within the sensing circuit 130. For example, the sensing circuit 130 may include a power processing circuit (not illustrated), and may change one low driving voltage and one high driving voltage so as to have different voltage levels according to modes.

As another example, multiple low driving voltages and multiple high driving voltages which have different voltage levels may be generated in an external circuit, and one low driving voltage and one high driving voltage may be selected by a selection circuit and may be supplied to the sensing circuit 130.

Figure 8:
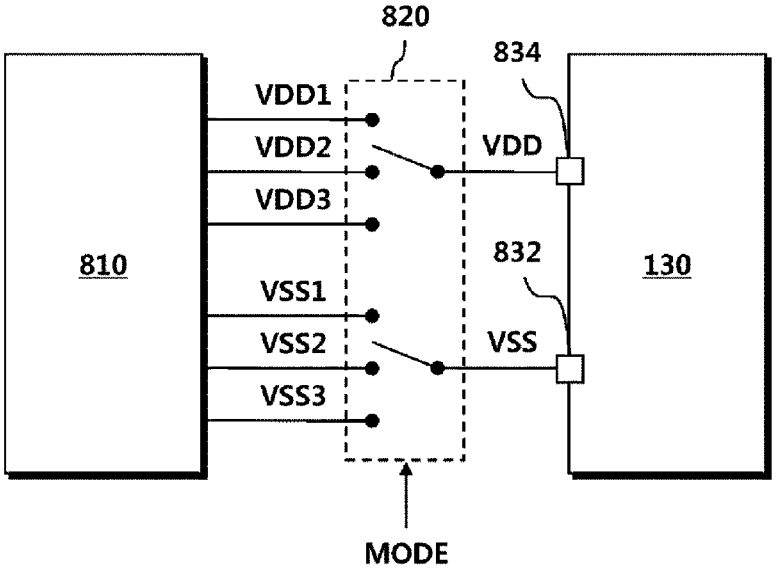
FIG. 8 is a view illustrating an example of selecting and supplying a low driving voltage and a high driving voltage through a selection circuit according to an embodiment of the present invention.

FIG. 8 is a view illustrating an example of selecting and supplying a low driving voltage and a high driving voltage through a selection circuit according to an embodiment of the present invention.

Referring to FIG. 8, a power management circuit 810 may generate multiple low driving voltages VSS1, VSS2, and VSS3, and multiple high driving voltages VDD1, VDD2, and VDD3.

According to each mode, one low driving voltage from among the multiple low driving voltages VSS1, VSS2, and VSS3 may be supplied to the sensing circuit 130, and according to each mode, one high driving voltage from among the multiple high driving voltages VDD1, VDD2, and VDD3 may be supplied to the sensing circuit 130.

Then, the multiple low driving voltages VSS1, VSS2, and VSS3, and the multiple high driving voltages VDD1, VDD2, and VDD3 may be supplied to the selection circuit 820. The selection circuit 820 may select one low driving voltage from among the multiple low driving voltages VSS1, VSS2, and VSS3 to deliver the selected low driving voltage to a low driving voltage reception terminal 832 of the sensing circuit 130, and may select one high driving voltage from among the multiple high driving voltages VDD1, VDD2, and VDD3 to deliver the selected high driving voltage to a high driving voltage reception terminal 834 of the sensing circuit 130.

According to a mode control signal MODE, the selection circuit 820 may select one low driving voltage from among the multiple low driving voltages VSS1, VSS2, and VSS3, and may select one high driving voltage from among the multiple high driving voltages VDD1, VDD2, and VDD3.

The selection circuit 820 may be disposed separately from the sensing circuit 130, or may be disposed within the sensing circuit 130.

The mode control signal MODE for selecting one of the multiple low driving voltages VSS1, VSS2, and VSS3, and one of the multiple high driving voltages VDD1, VDD2, and VDD3 may be received from the data processing circuit (refer to reference numeral 150 in FIG. 1). The selection circuit 820 may receive the mode control signal MODE from the data processing circuit (refer to reference numeral 150 in FIG. 1), and may determine a low driving voltage VSS and a high driving voltage VDD to be supplied to the sensing circuit 130.

In pixel sensing, the above-described embodiments of the present invention allow processing of a signal having a wide range by using a LV element. Also, the above-described embodiments of the present invention allow the use of a low-voltage element, and thus can increase the accuracy of pixel sensing and reduce the area of an element, thereby reducing the manufacturing costs.

Such terms as "include", "comprise", or "have" described hereinabove mean that the relevant elements may exist unless they are specifically described to the contrary, and thus, it should be construed that other elements may be further included rather than being excluded. Unless defined otherwise, all terms including technical and scientific terms have the same meanings as those commonly understood by those having ordinary knowledge in the technical field to which the present invention pertains. Such commonly-used terms as those defined in dictionaries should be interpreted as having meanings identical to contextual meanings of the related art, and will not be interpreted in an idealized or overly formal sense unless expressly so defined in the present invention.

The above description is only an illustrative description of the technical idea of the present invention, and those having ordinary knowledge in the technical field, to which the present invention pertains, will appreciate that various changes and modifications may be made to the embodiments described herein without departing from the essential features of the present invention. Therefore, the embodiments disclosed in the present invention are intended not to limit but to describe the technical idea of the present invention, and thus do not limit the scope of the technical idea of the present invention. The scope of the present invention should be construed based on the appended claims, and all of the technical ideas included within the scope equivalent to the appended claims should be construed as being included within the scope of the present invention.

What is claimed is:

1. A pixel sensing apparatus for sensing a characteristic of a pixel disposed in a display panel in a plurality of sensing modes, the pixel sensing apparatus comprising:

driving voltage reception terminals that are supplied with a low driving voltage (VSS) and a high driving voltage (VDD) each having a voltage level changed according to the plurality of sensing modes;

a sensing unit that is driven by the low driving voltage (VSS) and the high driving voltage (VDD) supplied from the driving voltage reception terminals, and receives, from the pixel, a sensing signal having a voltage level between the low driving voltage (VSS) and the high driving voltage (VDD); and an output unit that outputs pixel sensing data corresponding to the sensing signal, wherein the voltage level of the sensing signal changes according to the plurality of sensing modes.

2. The pixel sensing apparatus of claim 1, further comprising a voltage level conversion unit that receives an output signal of the sensing unit, converts the output signal into an analog signal having a voltage level within a predetermined range corresponding to an input voltage range of an analog-to-digital conversion unit, and outputs the analog signal to the analog-to-digital conversion unit.

3. The pixel sensing apparatus of claim 2, wherein the sensing unit transmits, to the voltage level conversion unit, a reference voltage determined according to voltage levels of the high driving voltage (VDD) and the low driving voltage (VSS), and the voltage level conversion unit recognizes a sensing mode according to the reference voltage.

4. The pixel sensing apparatus of claim 1, wherein withstand voltage levels of multiple first elements constituting the sensing unit and multiple second elements constituting the output unit are substantially identical to each other.

5. The pixel sensing apparatus of claim 1, wherein voltage differences between the low driving voltages (VSS) and the high driving voltages (VDD) in the respective sensing modes are substantially identical to each other.

6. The pixel sensing apparatus of claim 1, wherein, in relation to a driving voltage range of the sensing unit determined according to the low driving voltage (VSS) and the high driving voltage (VDD), the driving voltage ranges in at least two sensing modes partially overlap, and the driving voltage range in at least one sensing mode includes a voltage of 0 (zero).

7. A pixel sensing apparatus for sensing a characteristic of a pixel disposed in a display panel in a plurality of sensing modes, the pixel sensing apparatus comprising:

a sensing unit that is driven by a low driving voltage (VSS) and a high driving voltage (VDD) each having a voltage level changed according to the plurality of sensing modes, and receives, from the pixel, a sensing signal having a voltage level between the low driving voltage (VSS) and the high driving voltage (VDD);

an analog-to-digital conversion unit that converts an analog signal into digital data;

a voltage level conversion unit that receives an output signal of the sensing unit, and converts a voltage level of the output signal to generate the analog signal for transmitting to the analog-to-digital conversion unit, wherein the analog signal has a voltage level corresponding to an input voltage range of the analog-to-digital conversion unit; and an output unit that outputs pixel sensing data generated according to the digital data, wherein the voltage level of the sensing signal changes according to the plurality of sensing modes.

8. The pixel sensing apparatus of claim 7, wherein a difference value between the high driving voltage (VDD) and the low driving voltage (VSS) falls within a predetermined range with reference to values of withstand voltage levels of multiple first elements constituting the sensing unit.

9. The pixel sensing apparatus of claim 7, wherein maximum withstand voltage levels of elements constituting the sensing unit, the analog-to-digital conversion unit, the voltage level conversion unit, and the output unit are substantially identical to each other.

10. A panel driving apparatus for driving a panel having multiple pixels arranged therein and having multiple data lines and multiple sensing lines, which are connected to the pixels, arranged therein, the panel driving apparatus comprising:

a data driving circuit that converts image data into a data voltage and supplies the data voltage to the data lines; and a sensing circuit that is driven by a low driving voltage (VSS) and a high driving voltage (VDD) each having a voltage level changed according to a plurality of modes, receives, through the sensing lines, sensing signals each having a voltage level between the low driving voltage (VSS) and the high driving voltage (VDD), and generates pixel sensing data respectively corresponding to sensing signals, wherein the pixel sensing data is transmitted to a data processing circuit, and the data processing circuit performs processing for compensating the image data according to the pixel sensing data and then transmits the compensated image data to the data driving circuit, wherein the voltage level of each sensing signal changes according to the plurality of sensing modes.

11. The panel driving apparatus of claim 10, further comprising a power management circuit that generates multiple low driving voltages and multiple high driving voltages;

wherein, according to the plurality of modes, one low driving voltage from among the multiple low driving voltages is supplied as the low driving voltage (VSS), and according to the plurality of modes, one high driving voltage from among the multiple high driving voltages is supplied as the high driving voltage (VDD).

12. The panel driving apparatus of claim 11, wherein the plurality of modes are determined by the data processing circuit.

13. The panel driving apparatus of claim 11, further comprising a selection circuit that selectively outputs one low driving voltage from among the multiple low driving voltages and selectively outputs one high driving voltage from among the multiple high driving voltages.

14. The panel driving apparatus of claim 10, wherein, voltage differences between the low driving voltages (VSS) and the high driving voltages (VDD) in the respective sensing modes are substantially identical to each other.

* * * * *